US007454997B2

(12) United States Patent
Putney et al.

(10) Patent No.: US 7,454,997 B2
(45) Date of Patent: Nov. 25, 2008

(54) AXIAL PAWL RATCHET MECHANISM

(75) Inventors: Gordon A. Putney, L. Geneva, WI (US); Daniel S. Pusateri, Grayslake, IL (US)

(73) Assignee: Snap-on Incorporated, Kenosha, WI (US)

( * ) Notice: Subject to any disclaimer, the term of this patent is extended or adjusted under 35 U.S.C. 154(b) by 262 days.

(21) Appl. No.: 10/753,937

(22) Filed: Jan. 8, 2004

(65) Prior Publication Data

US 2004/0159191 A1 Aug. 19, 2004

Related U.S. Application Data

(60) Provisional application No. 60/438,708, filed on Jan. 8, 2003.

(51) Int. Cl.
*B25B 13/46* (2006.01)

(52) U.S. Cl. ..... 81/57.39; 81/57.13; 81/57.29; 81/58.3; 81/58.4; 81/60; 192/43; 192/46

(58) Field of Classification Search ..... 81/57.39, 81/58.3, 57.29, 57.13, 467, 473, 474, 475, 81/58.4, 60–63.2; 192/43, 46, 41 R, 30 R, 192/56.61, 69.8, 69.81
See application file for complete search history.

(56) References Cited

U.S. PATENT DOCUMENTS 3,621,738 A 11/1971 Northcutt
3,743,067 A * 7/1973 Bokovoy ..... 192/43
4,030,384 A * 6/1977 Newman ..... 81/58.3
4,479,409 A 10/1984 Antonius
4,939,961 A * 7/1990 Lee ..... 81/60
4,974,475 A * 12/1990 Lord et al. ..... 81/57.13
5,058,463 A * 10/1991 Wannop ..... 81/57.29
5,388,479 A * 2/1995 Sroka ..... 81/58.2
6,101,901 A * 8/2000 Daigle ..... 81/60
6,109,141 A 8/2000 Nurmi
2004/0089106 A1 * 5/2004 Wolfe et al. ..... 81/58.3

* cited by examiner

*Primary Examiner*—Joseph J. Hail, III
*Assistant Examiner*—Robert Scruggs
(74) *Attorney, Agent, or Firm*—Seyfarth Shaw LLP

(57) ABSTRACT

An axial pawl ratcheting mechanism is provided that may be used for a wrench and comprises a first disc including axial gear teeth on a first side providing for ratcheting in a first direction. A second disc is provided having axial gear teeth and peripheral gear teeth. The second disc is mounted to the first side of the first disc so that the first disc axial gear teeth engage the second disc axial gear teeth and provide an axial pawl ratchet assembly. A ratchet head is provided having an internally toothed opening for receiving the axial pawl ratchet assembly therein so that the peripheral gear teeth of the second disc engage the internal diameter teeth of the ratchet head in order to transfer torque between the ratchet head and the axial pawl ratchet assembly. An actuator is provided for adjusting the positioning of the axial pawl ratchet assembly between a first engagement position and a second engagement position. In the first engagement position the first disc and the second disc will ratchet in a first direction and transmit torque in a second direction and in the second engagement position the first and second discs will ratchet in the second direction and transmit torque in the first direction.

15 Claims, 13 Drawing Sheets

AXIAL PAWL RATCHET MECHANISM

RELATED APPLICATION

This application claims the benefit of the filing date of provisional application Ser. No. 60/438,708 filed Jan. 8, 2003.

BACKGROUND

This application relates to an axial pawl ratchet mechanism and in particular, to an axial pawl mechanism used with a hand tool or power tool to provide for application of torque in order to tighten or loosen a fastener.

Radial pawl systems are known for ratcheting mechanisms. A gear having peripheral teeth is mounted within the head of a tool and a pawl, formed as an individual finger, is pivotally mounted at the periphery of the gear. The pawl is biased into engagement with one or two teeth of the gear and when the head is rotated in one direction, transmits head rotation to the gear and when the head is rotated in the opposite direction, allows the head to undergo ratcheting rotation relative to the gear. The pawl generally includes a spring on either side in order to return the pawl to the engaged position against the teeth of the gear. In other embodiments, a radial pawl is provided which is a generally semicircular shaped disc having pawls formed by top corners of the disc. For example, U.S. Pat. No. 6,109,141 provides a reversible pawl disc that pivots between a first position, allowing ratcheting rotation in a first direction, and a second position, allowing for ratcheting rotation in a second direction. Such ratcheting pawl mechanisms have one to four teeth of the pawl engageable with the gear. Therefore, there is much vibration applied to a few teeth. As well, when the pawl engages the gear, in order to prevent rotation, there is a great amount of pressure against the teeth of the pawl. Therefore, such ratchet mechanisms provide a great amount of wear on the pawl and the lifetime of such pawls is limited.

While some pawl mechanisms are known that have teeth extending axially around the face of the disc, such systems have been very limited in their use and are not adaptable for use in most hand tools or power tools. Axial gear teeth of some prior art mechanisms are not easily adapted for bidirectional use. For example, U.S. Pat. No. 4,479,409 discloses a hand wrench having a crescent-shaped head portion having axial teeth formed on both sides. In order to provide for bidirectional ratcheting, the head portion must be removed completely from the wrench, inverted, and replaced on the wrench in the inverted position to provide for ratcheting in the opposite direction. Such a device is cumbersome to use and allows for the possibility that the head portion may be lost or displaced from the wrench.

Other currently available ratchets may backstop the drive body to the housing for chatter free operation, but require inversion for changing drive direction. Still other powered ratchets are directionally selectable through radially acting, symmetrical, pivoting pawls, but use varying degrees of friction for backstopping—the frictional approach being inefficient, less than 100% effective, a maintenance problem and inherently lacking the strength required for typical uses.

SUMMARY

This application discloses an improved axial pawl mechanism which avoids the disadvantage of prior ratcheting mechanisms, while affording additional structural and operating advantages.

An axial pawl ratcheting mechanism is provided comprising a first disc including axial gear teeth on a first side providing for ratcheting in a first direction. A second disc is provided having axial gear teeth and peripheral gear teeth. The second disc is mounted to the first side of the first disc so that the first disc axial gear teeth engage the second disc axial gear teeth and provide an axial pawl ratchet assembly. A ratchet head is provided having an internally toothed opening for receiving the axial pawl ratchet assembly therein so that the peripheral gear teeth of the second disc engage the internal diameter teeth of the ratchet head in order to transfer torque between the ratchet head and the axial pawl ratchet assembly. An actuator is provided for slidingly adjusting the axial positioning of the axial pawl ratchet assembly between a first engagement position and a second engagement position. In the first engagement position the first disc and the second disc will ratchet in a first direction and transmit torque in a second direction and in the second engagement position the first and second discs will ratchet in the second direction and transmit torque in the first direction.

In an embodiment, the first disc includes a second side having axial gear teeth that provide for ratcheting in a second direction. In an embodiment, a third disc is provided having axial gear teeth. The third disc is mounted to the second side of the first disc so that the first disc axial gear teeth engage the third disc axial gear teeth. In an embodiment, the ratchet head includes a drive body having a drive end and an adjustment end. In an embodiment, an actuator is attached to the adjustment end of the drive body. The actuator may provide for adjusting of the axial position of the drive body within the opening between a first engagement position and a second engagement position. In the first engagement position, the first disc and the second disc will ratchet only in a first direction and transmit torque in a second direction to the drive body. In the second engagement position, the first disc and second disc will ratchet only in a second direction and transmit torque in the first direction to the drive body. In an embodiment, a bore is formed in the ratchet head and has an inner diameter engagement area. In an embodiment, the mechanism includes a drive body having an outer diameter engagement portion. The outer diameter engagement portion is mounted in the bore and the outer diameter engagement portion engages the inner diameter engagement portion. The first and second discs and the drive body are assembled together to form the axial pawl ratchet assembly and the drive body provides for rotation of the first and second disc.

In an embodiment, the axial gear teeth of the first and second discs pass over one another to provide overrunning or ratcheting. A ratchet head is oscillated and rotates the second disc via the peripheral radial gear teeth interconnected with the inner diameter teeth of the ratchet head. A pawl spring mounted to the drive body and the pawl spring received by and biasing the first discs by use of a selector knob attached to the drive body. Torque is transmitted from the second disc through the first disc and into a third disc. The third disc is locked to the drive body and the drive body may rotate within the opening of the ratchet head. The second disc remains fixed within the ratchet head and the axial gear teeth on the first side of the first disc ratchet against the axial gear teeth of the second disc and the axial gear teeth of the second side of the first disc will oscillate on the axial gear teeth of the third disc against which the first disc is biased. The ratchet head may be reversed so that a first mechanism including an axial pawl ratchet assembly may lock-up in order to backstop the drive body. In an embodiment, a second mechanism including the axial pawl ratchet assembly may provide a backstop to the ratchet head to provide anti-chatter friction so that every advance given by oscillating the second mechanism is used and prevents slippage.

In an embodiment a wrench is provided comprising a ratchet head including a bore having an inner diameter having teeth forming a first and second row, a first and second pawl disc each having peripheral gear teeth and axial gear teeth, a ratchet disc having a first and second side, each having axial gear teeth and the ratchet disc is mounted between the first and second pawl discs providing a backstopping assembly where the axial gear teeth of the first side of the ratchet disc engage the axial gear teeth of the first pawl disc and the axial gear teeth of the second side of the ratchet disc engage the axial gear teeth of the second pawl disc and an actuator mounted in the ratchet head and coupled to the backstopping assembly in order to move the axial pawl ratchet assembly between a first position where the first pawl disc has peripheral gear teeth engage the first row of teeth of the ratchet head so that the first pawl disc will ratchet in a first direction and transmit torque in a second direction and a second position where the second pawl disc has peripheral gear teeth engage the second row of teeth of the ratchet head so that the second pawl disc will ratchet in the second direction and transmit torque in the first direction.

In an embodiment the ratchet disc is a bidirectional disc. The actuator may include a drive body having a drive end and an adjustment end. The actuator may be adjusted axially within the bore between a first position and a second position via adjustment of a selector knob attached to the adjustment end. In the first position, the first pawl disc will ratchet only in a first direction and transmit torque in the second direction to the drive body. In the second position, the second pawl disc will ratchet only in the second direction and transmit torque in the first direction to the drive body. The drive body may have an outer diameter engagement portion received by a rotatable selector knob. The ratchet head may include an oscillating means.

In an embodiment an axial pawl ratchet mechanism is provided comprising a pawl disc including axial gear teeth on a first side providing for ratcheting in a first direction and a second side having axial gear teeth that provide for ratcheting in the second direction, a ratchet disc having axial gear teeth and peripheral radial gear teeth and disposed so that the first disc axial gear teeth are engageable with the pawl disc axial gear teeth, a ramp disc is provided having axial gear teeth and peripheral gear teeth and the ramp disc is mounted to the second side of the pawl disc so that the pawl disc axial gear teeth engage the ramp disc axial gear teeth to provide an axial pawl ratchet assembly, a ratchet head having an opening having inner diameter teeth and disposed for receiving the axial pawl ratchet assembly therein so that the peripheral gear teeth of the ratchet disc engage the inner diameter teeth of the ratchet head in order to transfer torque between the ratchet head and the axial pawl ratchet assembly and an actuator coupled to the axial pawl ratchet assembly for adjusting the axial position of the axial pawl ratchet assembly between a first engagement position and a second engagement position, so that in the first engagement position the ratchet disc is fixed within the ratchet head and the pawl disc can overrun or ratchet along the ratcheting disc and pawl disc interface while oscillating on the ramp disc against which it is biased in a left or right position so that the pawl disc and the ratchet disc will ratchet in a first direction and transmit torque in a second direction and in the second engagement position the pawl disc is biased in the other of the left or right position against the ramp disc and the pawl disc and the ratchet disc will ratchet in the second direction and transmit torque in the first direction.

In an embodiment a pawl spring may be mounted to the actuator and an end of the pawl spring is received by and biases the pawl disc via a selector knob attached to the actuator. Torque may be transmitted from the ratchet disc through the pawl disc and into the ramp disc. The ramp disc is locked to the drive body and the drive body may rotate. The ratchet head is reversed so that a first mechanism including an axial pawl ratchet assembly may lock up in order to backstop the drive body. A second mechanism may be provided including the axial pawl ratchet assembly providing a backstop to the ratchet head to provide anti-chatter friction so that every advance given by oscillating the second mechanism is used and prevents slippage.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
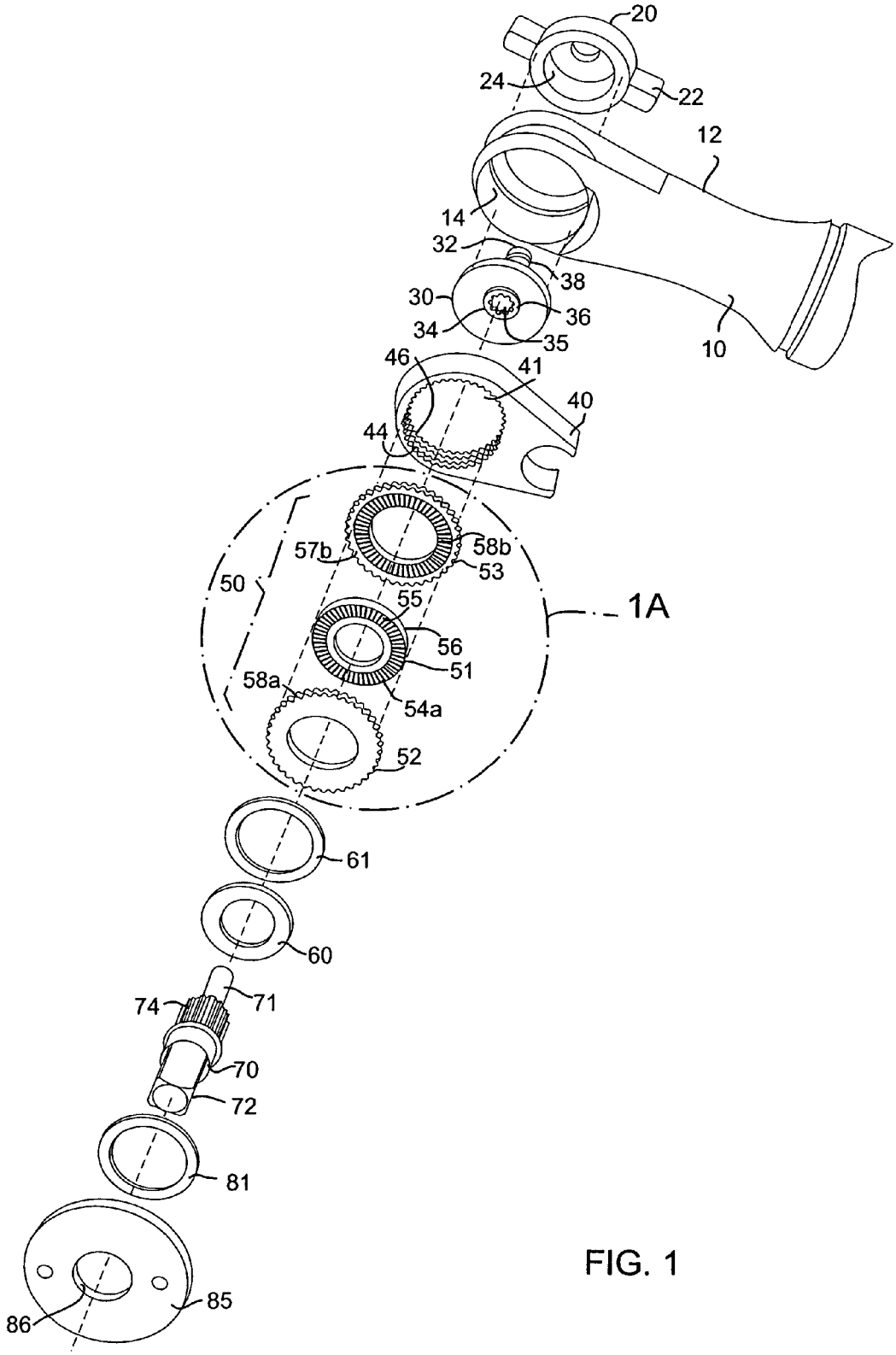
FIG. 1 is a perspective exploded view of an embodiment of an axial pawl ratchet mechanism.
Figure 2:
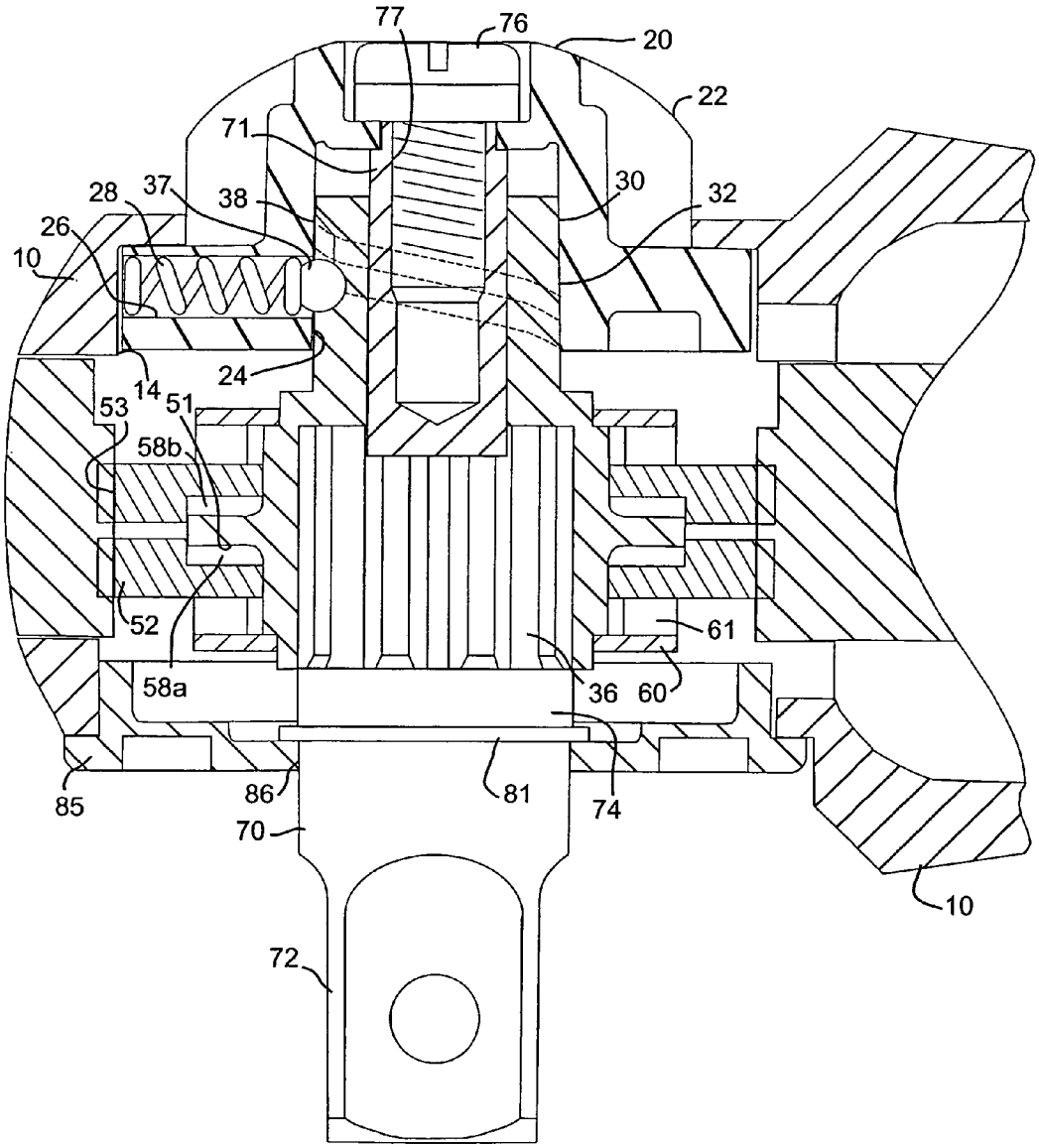
FIG. 2 is an enlarged, fragmentary, sectional view of an assembled axial pawl ratchet mechanism similar to that shown in FIG. 1.
Figure 3:
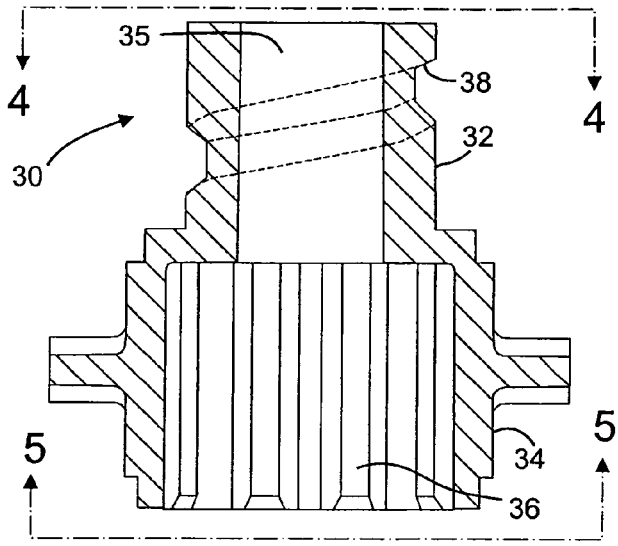
FIG. 3 is a sectional view of a pawl carrier of the axial pawl ratchet mechanism of FIG. 1.
Figure 4:
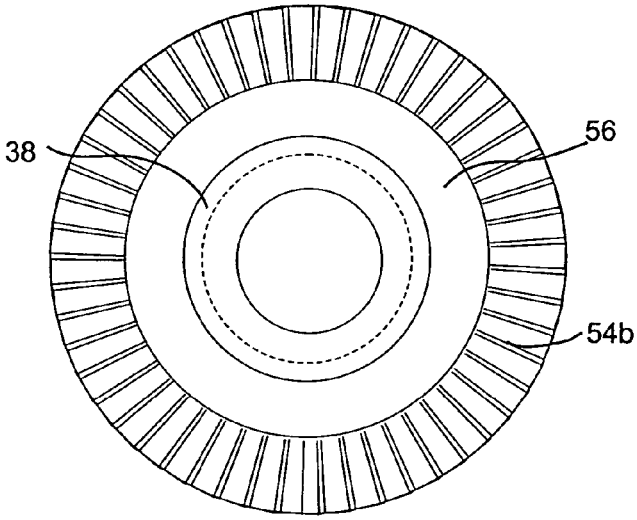
FIG. 4 is a top plan view of the pawl carrier of FIG. 3 taken at line 4-4.
Figure 5:
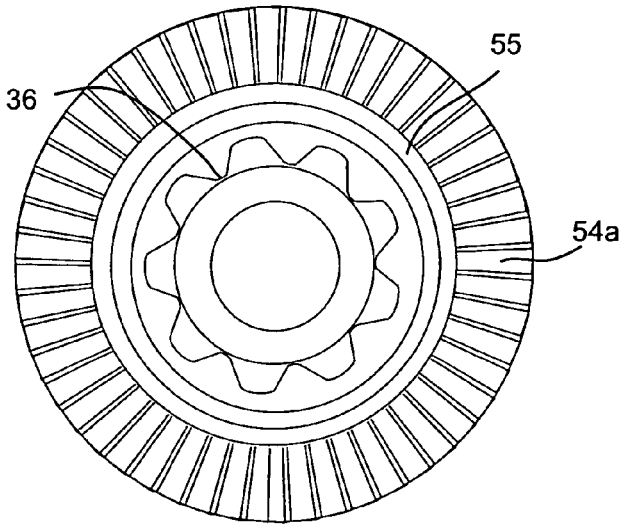
FIG. 5 is a bottom plan view of the pawl carrier of FIG. 3 taken at line 5-5.

Referring to FIGS. 1, 2 and 3, there is illustrated an embodiment of an axial pawl ratchet mechanism. A tool body 10 or ratchet head housing is provided having a shaft 12 having an aperture 14 formed therein. In an embodiment, the tool 10 may be either a manually operated tool, such as a hand wrench, or a power tool, such as an air wrench. Attached at one end of the aperture 14 is an actuator, for example a selector knob 20. The selector knob 20 includes a protrusion 22 and an inner wall 24 having a spring aperture 26 formed radially therein for receiving a spring 28. Mounted within the aperture 14 is a pawl carrier 30. The pawl carrier 30 includes an adjustment end 32 and an engagement end 34. A bore 35 is formed between the adjustment end 32 and engagement end 34. The bore 35 is toothed, or serrated along an inner diameter. Each tooth 36, in a preferred embodiment, has a generally rectangular shaped distal portion. The adjustment end 32 includes a spiral channel 38 formed in its outer surface. A spherical ball 37 rides in the spiral channel 38. The ball 37 is seated in the aperture 26 against the spring 28, which urges it into engagement in the spiral channel 38 (see FIG. 2). As will be discussed in more detail below, the rotation of the selector knob 20 causes the ball 37 to ride in the spiral channel 38 in order to move the pawl carrier 30 axially in the aperture 14.

Figure 1A:
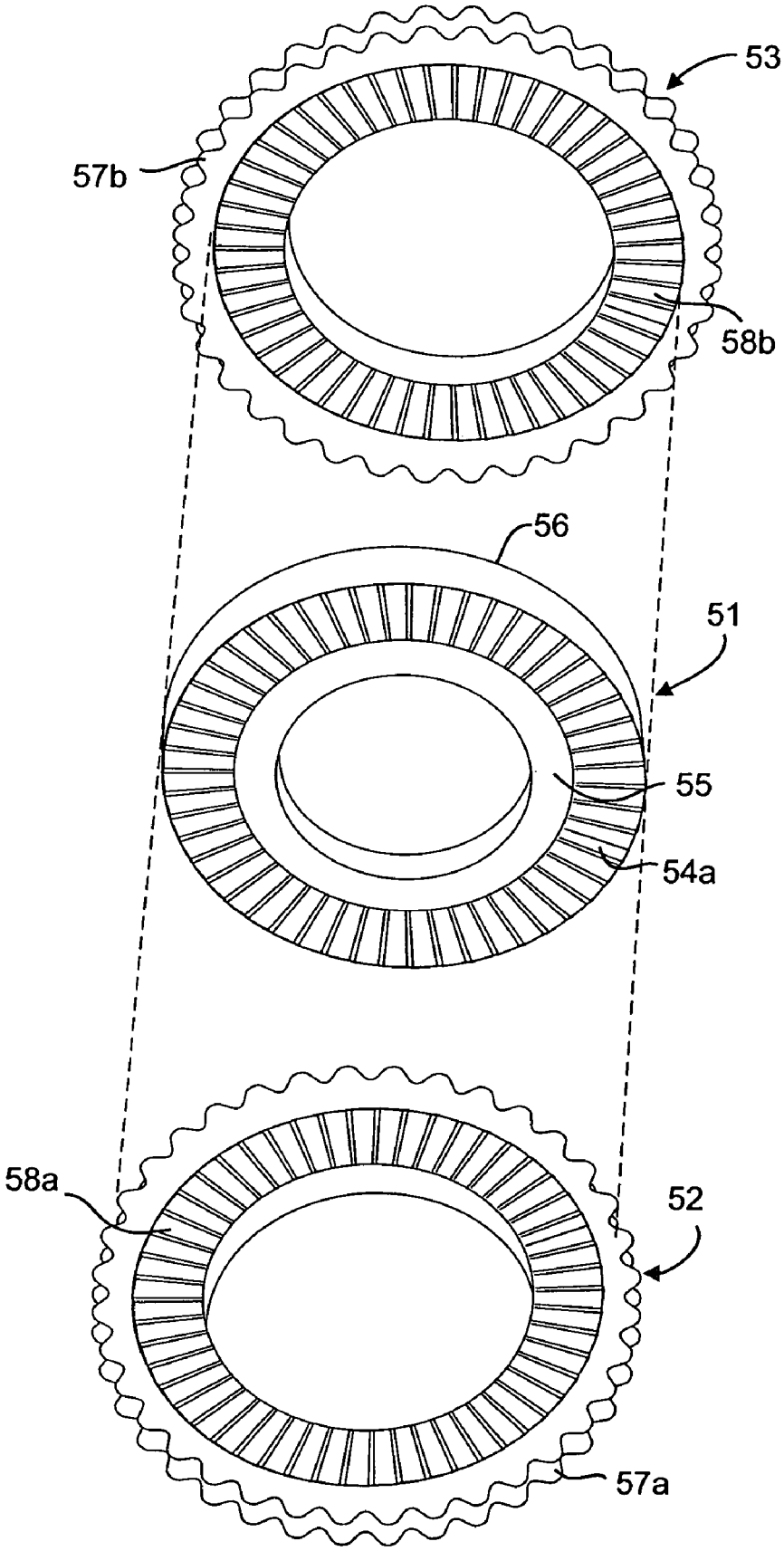
FIG. 1*a* is an enlarged perspective exploded view of a backstopping assembly of the axial pawl ratchet mechanism of FIG. 1.
Figure 6:
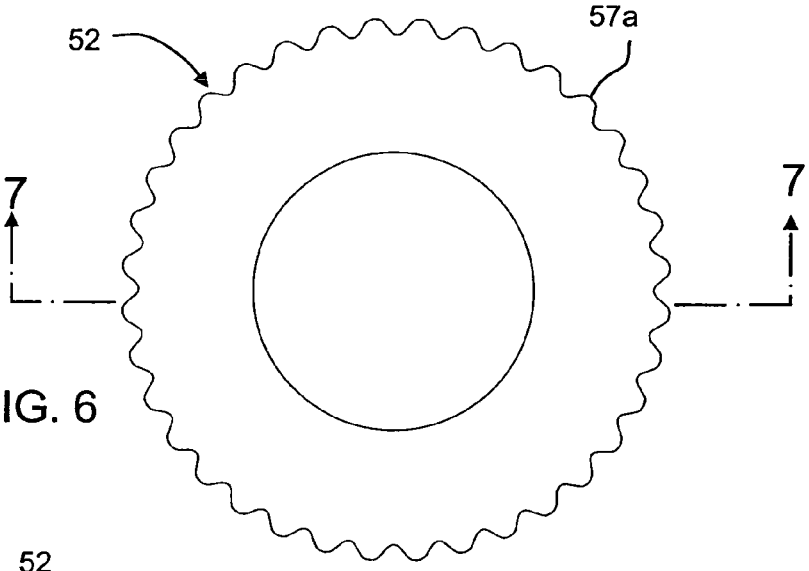
FIG. 6 is a bottom plan view of a pawl disc of the axial pawl ratchet mechanism of FIG. 1.
Figure 7:
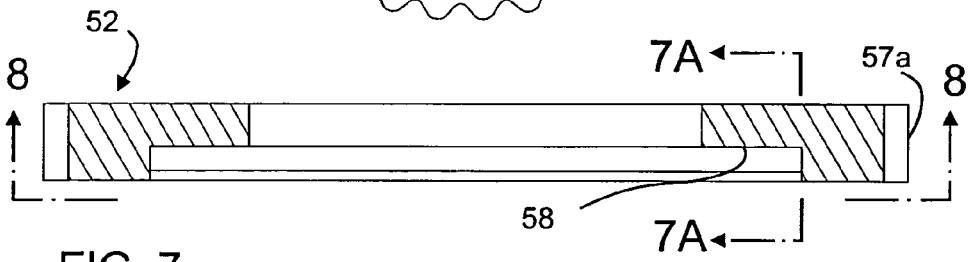
FIG. 7 is a sectional view taken along line 7-7 in FIG. 6.
Figure 8:
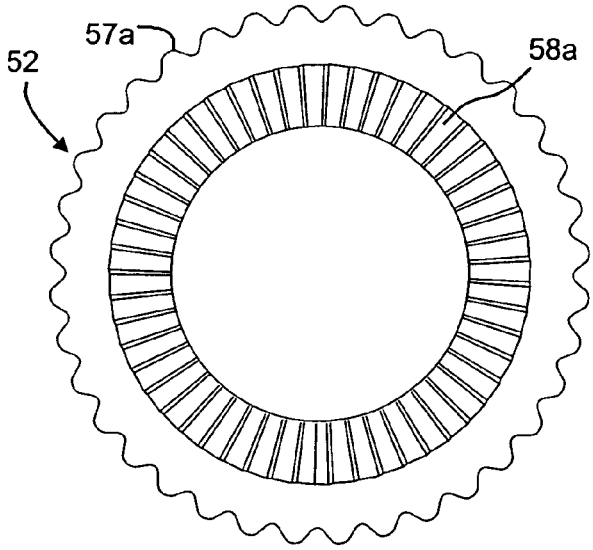
FIG. 8 is a bottom plan view of FIG. 7 taken at line 8-8.
Figure 10:
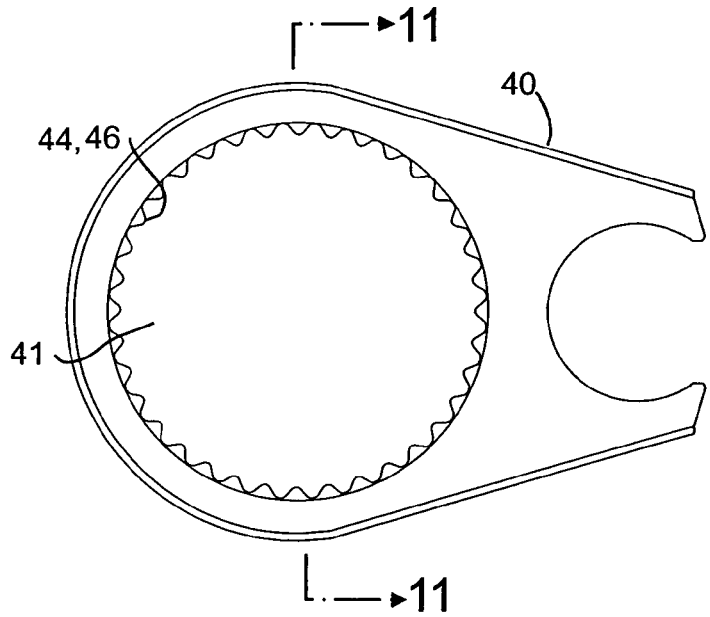
FIG. 10 is an enlarged plan view of a ratchet head of the axial pawl ratchet mechanism of FIG. 1.
Figure 11:
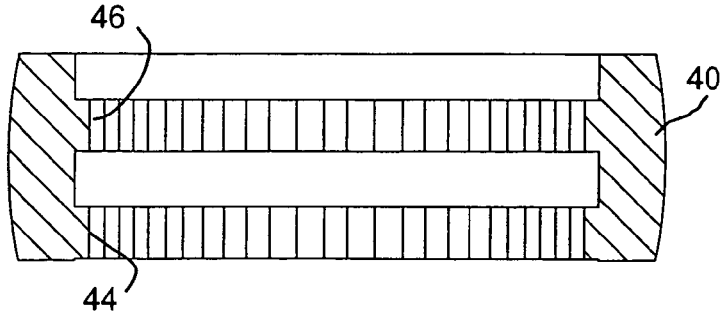
FIG. 11 is a sectional view taken at line 11-11 in FIG. 10.

Referring also to FIGS. 10 and 11, the pawl carrier 30 is mounted within a ratchet head 40, which includes an opening 41 which has first row internal of gear teeth 44 axially spaced from a second row of internal gear teeth 46. Referring also to FIGS. 1*a* and 4-8, there is mounted within the opening 41 a backstopping assembly 50 which, in an embodiment, includes a first disc 51 which, in an embodiment, is a ratchet disc; a second disc 52 which, in an embodiment, is a pawl disc; and third disc 53 which, in an embodiment, is also a pawl disc. In an embodiment, the backstopping assembly 50 provides an axial pawl ratchet mechanism. In an embodiment, the ratchet disc 51 is a bidirectional disc having axial teeth 54*a* and 54*b*, respectively on a first side 55 and a second side 56 of the disc 51 (see FIGS. 4 and 5). In an embodiment, the second and third pawl discs 52, 53 are formed identically so that only one is described in detail. Referring to FIGS. 6-8, the pawl disc 52 includes peripheral gear teeth 57*a*, and axial gear teeth 58*a*, on a single side. (Corresponding sets of teeth on the pawl disc 53 are designated 57*b* and 58*b* in FIG. 1 to facilitate and distinguish the pawl discs.) As shown in FIG. 1, the second axial pawl disc 52 has its smooth side visible. In FIG. 1*a*, the disc 52 is illustrated so that it is inverted from the position shown in FIG. 1, so that gear teeth 58*a* are visible.

Figure 7A:
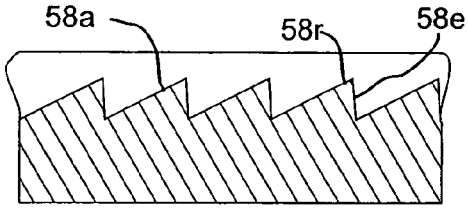
FIG. 7*a* is an enlarged, fragmentary, sectional view of taken at line 7*a*-7*a* in FIG. 7.

Therefore, it can be understood that the axial gear teeth 58*a* of second disc 52 engage the axial gear teeth 54*a* of the first side 55 of the ratchet disc 51, and the axial gear teeth 58*b* of the third disc 53, engage the axial gear teeth 54*b* on the second side 56 of the ratchet disc 51. In an embodiment, each tooth of the gear teeth 58*a* of the second disc 52 includes a ramp surface 58*e* included in a first direction (see FIG. 7*a*). Each tooth of the gear teeth 58*b* of the third disc 53 includes a ramp surface slanted in a second direction because of the inverted position of the disc 53 in assembly. Thus, the second gear disc 52 gear teeth 58*a* ramp surfaces 58*r* will provide for ratcheting against the gear teeth 54*a* of the ratchet disc 51 in a first direction, and the gear teeth 58*b* ramp surfaces 58*r* of the third disc 53 will engage the gear teeth 54*b* (see FIG. 4) of the ratchet disc 51 to ratchet in a second direction. Likewise, each tooth of the axial teeth 58*a* includes an edge 58*e* (FIG. 7*a*) that will abut the gear teeth 54*a* of the first side 55 of the ratchet disc 51 and prevent movement and transfer torque in a second direction. As well, the axial gear teeth 58*b* have oppositely faced edges 58*e* that will abut the gear teeth 54*b* of the second side 56 of the ratchet disc 51 and transfer torque in a first direction.

In an embodiment, the ratchet disc 51 may be attached to the pawl carrier 30. For example, the ratchet disc 51 may be formed integrally with the pawl carrier 30 or it may be welded thereto. As shown in FIG. 2, the ratchet disc 51 is formed as one piece with the pawl carrier 30. In an alternate embodiment, the first, second and third discs 51, 52, 53 may be formed separately and mounted to the engagement end 34 of the pawl carrier 30, as shown in FIGS. 1, 1*a* and 3. A wave washer 60 helps to attach the backstopping assembly 50 to the pawl carrier 30. A resilient member 61, such as an annular metal spring, may be provided in order to allow for the second and third pawl discs 52, 53 to be urged against the ratchet disc 51 while allowing for some oscillation or movement of the second or third pawl discs 52, 53 when ratcheting occurs.

The backstopping assembly 50 is mounted to the pawl carrier 30, which is all assembled within the ratchet head 40. The ratchet head 40 may oscillate within the tool body 10. Upon mounting within the aperture 41 of the ratchet head 40, the backstopping assembly 50 and pawl carrier 30 may be provided in a first engagement position where the peripheral gear teeth 57*a* of the second disc 52 are aligned with the first row of gear teeth 44. Upon engagement of the peripheral gear teeth 57*a*, the second disc 52 is engaged and may either ratchet or transfer torque between the ratchet head 40 and the axial pawl ratchet mechanism 50. As discussed above, the second axial pawl disc 52 will only ratchet in a first direction. Therefore, by selecting the first engagement position where the second pawl disc 52 is aligned to the first row 44 of gear teeth on the ratchet head 40, ratcheting in a first direction or transfer of torque in a second direction is obtained.

The axial pawl ratchet mechanism 50 is basically comprised of two unidirectional pawl discs 52, 53 and one pawl carrier having a ratchet disc 51. Torque is transmitted from drive mechanism 50 via conventional radial teeth 57*a, b* located along the periphery of the pawl discs 52, 53. Torque is then transmitted from pawl disc 52 or 53 to pawl disc carrier 51, via unidirectionally ramped axial teeth 54*a, b*. Each peripheral tooth 57*a, b* has a corresponding ramped tooth 58*a, b*. Torque transmission continues from pawl carrier ratchet disc 51 to drive body 70, or output spindle via conventional matching teeth 74, or splines. Two axial pawl discs 52, 53 are respectively situated above and below the ratchet disc 51 of the backstop assembly 50 with the lower pawl disc 52 inverted for engagement between teeth 58*a* and 54*a*. This inverted condition provides for opposite rotational opportunity. Pawl discs 52, 53 are axially spring loaded to assure tooth face contact via wave washers 60. The pawl carrier 30 includes an adjustment end having spiral groove 38 on its cylindrical exterior. The selector knob 20 is affixed to one end 71 of the drive body 70 but allowed rotational freedom. The spring-loaded ball 37 located in selector knob 20, engages in the pawl carrier spiral groove 38. Rotation of selector knob 20 effects axial travel of the pawl carrier 30 and drive body 70 in order to actuate the axial pawl ratchet assembly 50. This axial travel allows selection of a first and second engagement positions affecting consequent drive direction.

Upon rotation of the selector knob 20, for example, clockwise, the pawl carrier 30 will move axially through the aperture 41 to the second engagement position in order to align the third axial pawl disc 53 with the second row 46 of gear teeth in the ratchet head 40. This provides for the backstopping assembly 50 to be positioned in a second engagement position so that the third axial pawl disc 53 is engaged so that it can ratchet in a second direction or transfer torque in a first direction.

In an embodiment, the first row 44 and second row 46 of gear teeth within the ratchet head 40 are axially spaced so that only one of the second or third discs 52, 53 may be engaged at a time. In other words, when the second axial pawl disc 52 is engaged in the first engagement position, aligned with the first row 44, the third axial pawl disc 53 will not be aligned or engaged with the second row 46 of gear teeth. Therefore, no ratcheting or torque transfer will occur via the third axial pawl disc 53. Likewise, when the third axial pawl disc 53 is in the second engagement position, aligned and engaged with the second row of gear teeth 46 on the ratchet head 40, the second axial pawl disc 52 is not aligned with the first row 44 gear teeth of the ratchet head 40 and the second axial pawl disc 52 cannot provide ratcheting or transfer of torque.

Figure 9:
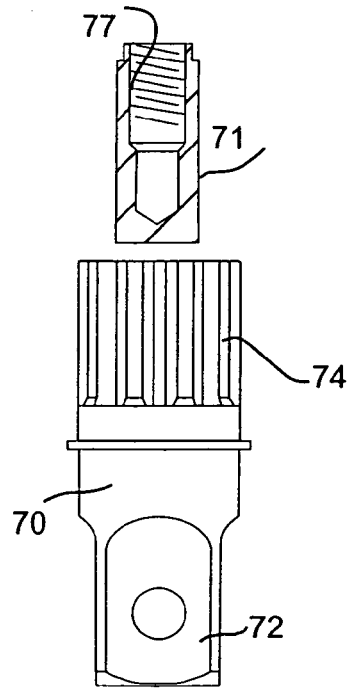
FIG. 9 is an enlarged side elevational view in partial section of a drive body of the axial pawl ratchet mechanism of FIG. 1.

Referring also to FIG. 9, the drive body 70 includes a shaft 71 and opposed thereto a square drive member 72. In an alternate embodiment, the drive member 72 may have other shapes, such as hexagonal or pentagonal. Intermediate the shaft 71 and square drive member 72, is a toothed engagement area 74. The drive body 70 is assembled by inserting the shaft 71 into the bore 35 of the pawl carrier 30 so that the engagement area 74 is received by and engages teeth 36 formed on the inner diameter of the bore 35. The drive member teeth 74 positively engage pawl carrier teeth 36 so that any rotation or oscillation of the pawl carrier 30 is transmitted to the drive body 70 and vice versa. In an embodiment, the drive body 70 is attached to the pawl carrier 30 via a fastener 76 (FIG. 2), such as a screw, mounted through the selector knob 20 into a bore 77 formed in the shaft 71 of the drive body 70 (see FIG. 9). The assembly of the axial ratchet mechanism is completed by attaching an additional washer 81 and cap 85 (FIGS. 1 and 2) over the square drive member 72, which protrudes through a hole 86 in the cap 85.

Therefore, it may be understood that, when the selector knob 20 is oriented so that the pawl carrier 30 is provided in the first engagement position, where the second axial pawl disc 52 engages the first row of gear teeth 44 of the ratchet head 40, ratcheting will be provided in a first direction and torque provided in a second direction to the square drive member 72. For example, in an embodiment, the first direction may be clockwise. In order to loosen a fastener, the axial pawl ratchet mechanism 50 is oriented in the first engagement position to apply torque in a counterclockwise direction. When the tool is in a take-up motion (for example, in the case of a manual hand tool when the handle is being returned to a working position), the tool 10 will ratchet in the clockwise direction prior to applying loosening torque in a counterclockwise direction. When it is desired to tighten the fastener engaged by the square drive member 72, the selector knob 20 is rotated, for example in the clockwise direction, in order to axially adjust the pawl carrier 30 to a second engagement position, where the third pawl disc 53 engages the second row 46 of gear teeth of the ratchet head 40. The rotation of the selector knob 120 causes the ball 37 to ride in the spiral channel 38 of the carrier 30 and move the carrier axially within the opening 41. Once in the second engagement position, the third pawl disc 53 allows for ratcheting in the counterclockwise direction and tightening and transfer of torque by the square drive member 72 clockwise. In an embodiment, the tool 10 may also include an anti-chatter mechanism. For example, the handle 12 may include a backstopping assembly.

FIGS. 12-23 depict a second embodiment of an axial pawl ratchet mechanism incorporated in a tool 100. The tool 100 includes a tool body 110 or ratchet head housing having an aperture 114 and selector knob 120. The aperture 114 receives a first axial pawl ratchet mechanism 131 and a second axial pawl ratchet mechanism 132. In an embodiment, the first mechanism 131 acts to provide for an anti-chatter mechanism and the second mechanism 132 provides a bi-directional ratcheting and torque transmission backstopping assembly. In general, the first and second mechanisms 131, 132 operate the same, except that the first mechanism 131 operates between a drive body 170 and the tool body or ratchet head housing 110 and the second mechanism 132 functions as an oscillating mechanism operating between the drive body 170 and the ratchet head 140. Although the illustrated embodiment includes both the first and second mechanisms 131 and 132 combined in the same tool, alternate embodiments may be provided where a tool has only an anti-chatter mechanism, such as the first mechanism 131. Other embodiments may be provided where a tool has only a backstopping mechanism, such as the second mechanism 132. However, the actual operation of the components of the first and second mechanisms 131, 132 are similar. Therefore, the description of the operation of these gear assemblies will be discussed only with regard to the second mechanism 132.

Figure 14:
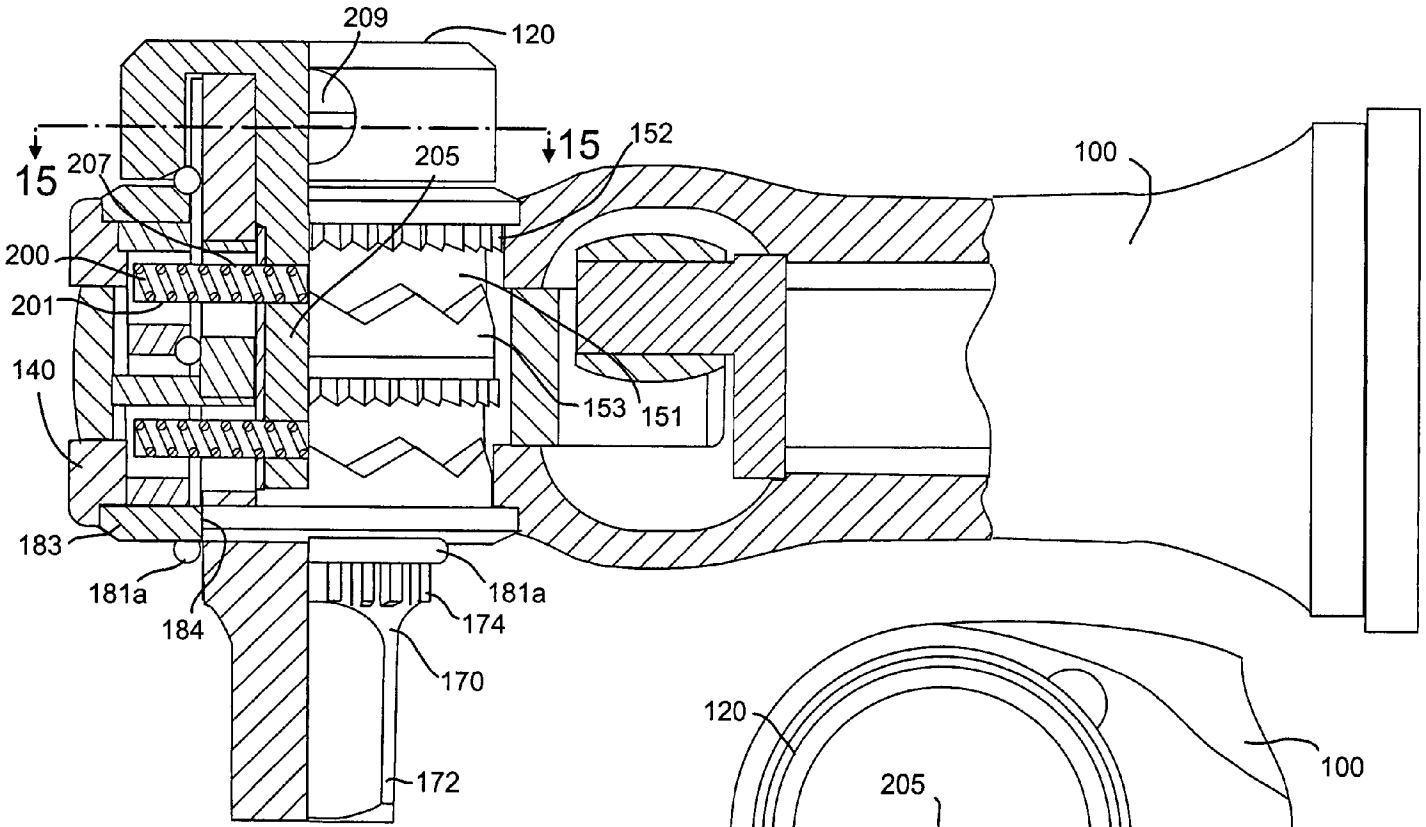
FIG. 14 is a fragmentary side elevation view in partial section taken at line 14-14 in FIG. 13.
Figure 16:
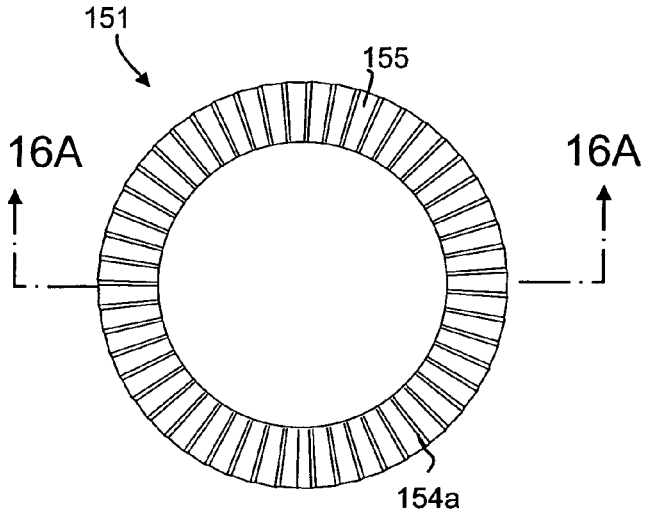
FIG. 16 is a plan view of a pawl disc of the axial pawl ratchet assembly of FIG. 12.
Figure 16A:
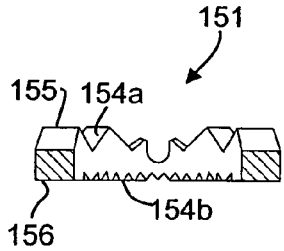
FIG. 16*a* is a sectional view taken at line 16*a*-16*a* in FIG. 16.
Figure 17:
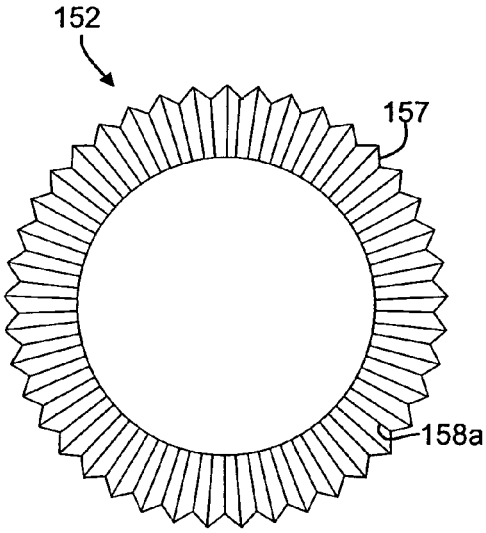
FIG. 17 is a plan view of a ratchet disc of the axial pawl ratchet mechanism of FIG. 12.
Figure 18:
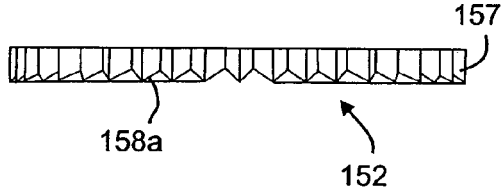
FIG. 18 is a side elevation view of a ratchet disc of FIG. 17.
Figure 19:
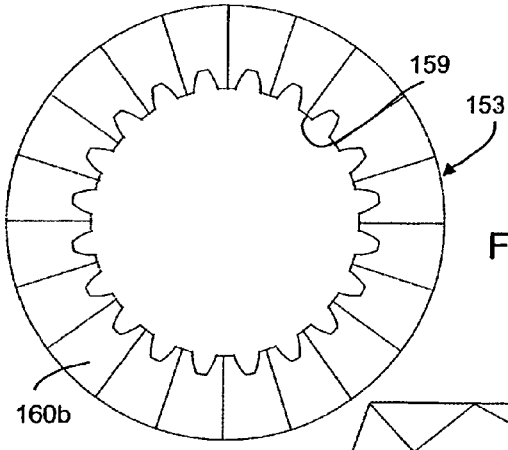
FIG. 19 is a plan view of a ramp disc of the axial pawl ratchet mechanism of FIG. 12.
Figure 20:
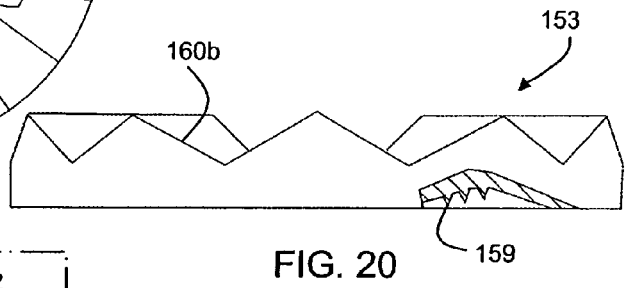
FIG. 20 is a side elevation, partially sectioned, view of the ramp disc FIG. 19.

The tool body 110 includes a ratchet head 140 (see FIG. 12) that, in an embodiment, includes the aperture 114*a*. The apertures 114, 114*a* receive a first disc 151, for example a pawl disc; a second disc 152, for example a ratchet disc; and a third disc 153, for example a ramp disc. Referring to FIGS. 16 and 16*a*, the pawl disc 151 is cylindrical in shape and includes coarse axial teeth 154*a* on a first side 155. Axial teeth 154*b* are formed on a second side 156 and are much more closely spaced than the coarse teeth 154*a*. The ratchet disc 152 includes axial teeth 158*a* and peripheral radial teeth 157 (see FIGS. 17 and 18). The ratchet disc 152 is rotated by the ratchet head 140 which may oscillate within aperture 114 of the tool body 110. The ratchet head 140 has radial internal teeth 144 (similar to gear teeth 44 of FIG. 1) that line up to maintain constant engagement with the ratchet disc 152 to provide keying. In an embodiment, the ratchet disc 152 can float axially so it does not take any axial loads, in order not to affect the action of the disc 152. The ratchet disc teeth 158*a* have angles which are rather shallow to provide an axial camming action. Two retaining rings 181 absorb the separating forces. In an embodiment, one retaining ring 181 abuts against a cap 183 that includes a groove 184 (see FIG. 14) formed for receiving the retaining ring 181. In an embodiment, the retaining ring 181 may have a square shape outer portion and is received in a square bottom groove (not shown). In an alternate embodiment, as shown in FIG. 14, the retaining ring 181 a has a circular shaped diameter and is received in a V-shaped groove 184 that provides for a self-locking feature in order to compress the first and second mechanisms 131, 132 together. Note that the position of the drive body 170 is fixed in relation to the ratchet head 140 via the retaining rings 181 mounted in grooves 184 and channels 182 (see FIG. 21) formed in the drive body 170.

Figure 21:
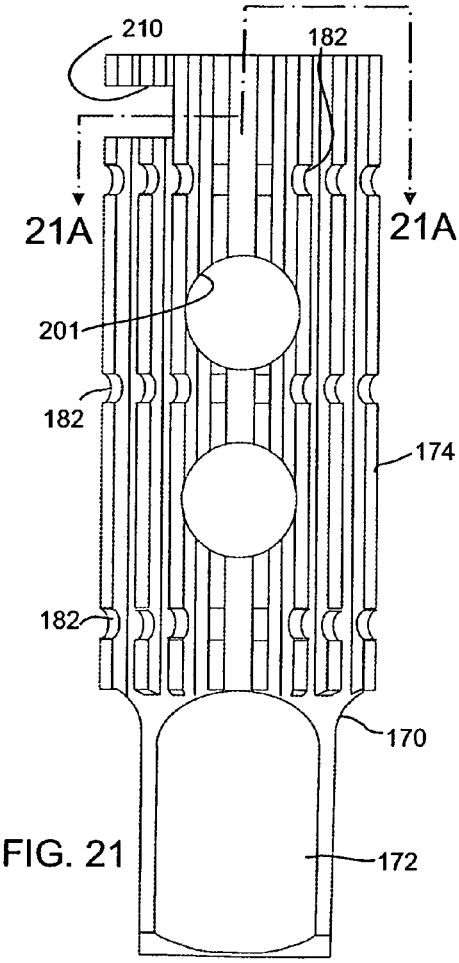
FIG. 21 is a side elevation view of the drive body of the axial pawl ratchet mechanism of FIG. 12.
Figure 21A:
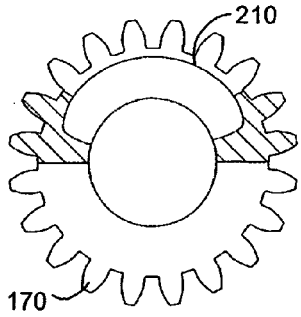
FIG. 21*a* is an end elevation view in partial section taken at line 21*a*-21*a* in FIG. 21 and rotated 180° therefrom.
Figure 22:
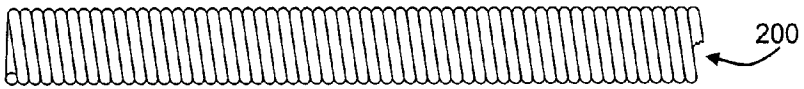
FIG. 22 is an enlarged side elevational view of a spring of the axial pawl ratchet mechanism of FIG. 12.

The ramp disc 153 includes axial teeth 160*b* that, in an embodiment, are coarse. The ramp disc 153 includes on its inner diameter a toothed surface 159 (see FIGS. 19 and 20). In an embodiment, the ramp disc 153 includes ten-pitch teeth on its axial face. Each of the first, second and third discs 151, 152, 153 has bores which are aligned to receive the drive body 170 therethrough. Referring to FIGS. 21 and 21*a*, the drive body 170 includes a square drive member 172 and an engagement area 174. The engagement area 174, in an embodiment, is toothed and corresponds to the toothed inner diameter portion 159 of the ramp disc 153. The selector knob 120 is concentric with the drive body 170. The ratchet disc 152 oscillates axially as it rotates with the inner gear 144. The drive 170 body advances using the ratchet disc 152 motion transferred through the teeth 159 of the ramp disc 153 to the drive body 170 and stays in place during overrunning of the ratchet disc 152 when it goes back for another bite.

Figure 12:
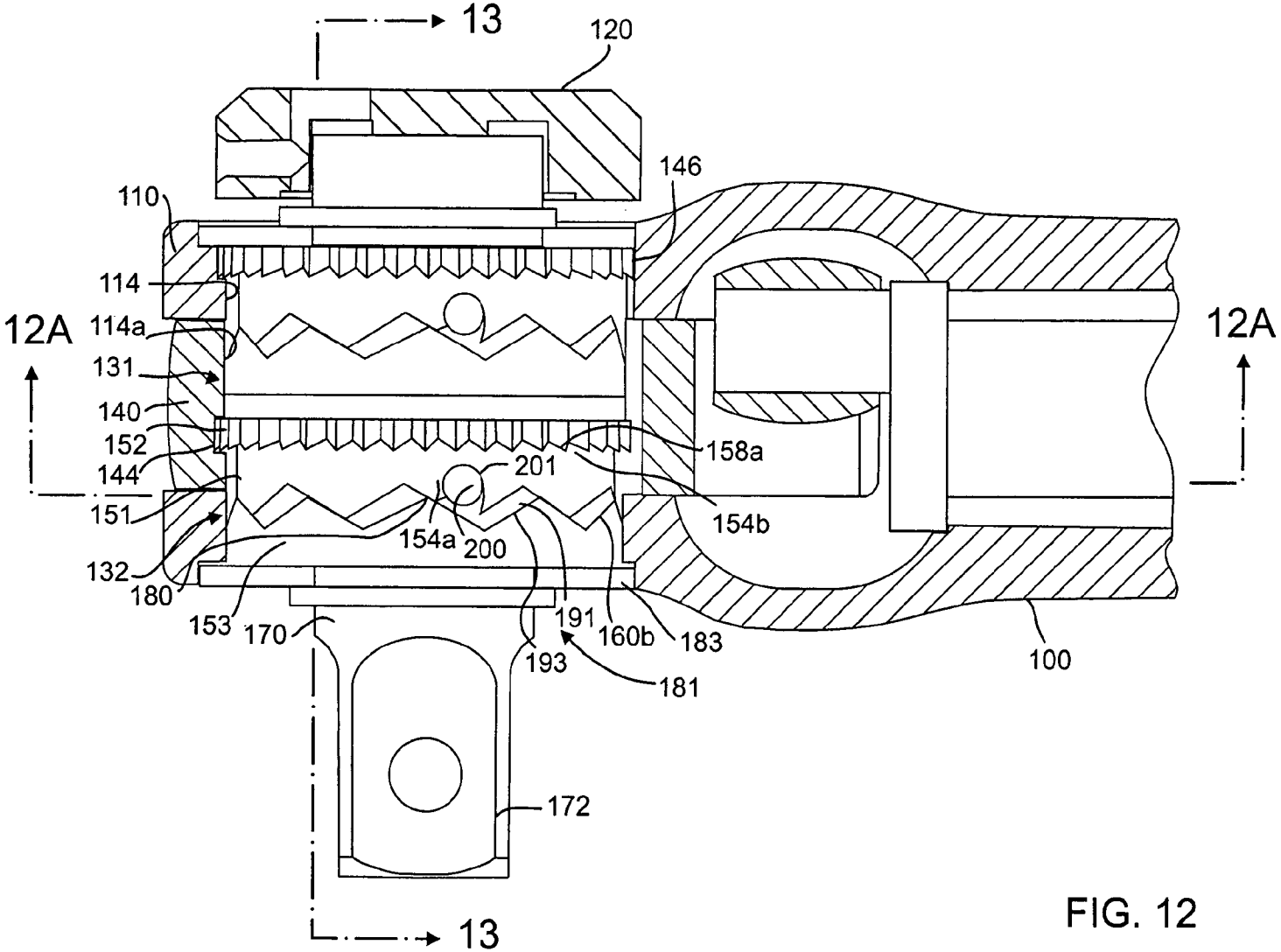
FIG. 12 is a fragmentary sectional view of a further embodiment of an axial pawl ratchet mechanism.

The backstopping assembly 132 operates in order to ratchet and transfer torque by the coarse teeth 154*a* of the pawl disc loosely received by the gear teeth 160*b* of the ramp disc 153. For example, as shown in FIG. 12, the pawl disc gear teeth 154*a* are abutting the left side point 180, near the crest of the tooth (e.g. 160*b*). In this position, when the ratchet disc 152 is moved to the left (in FIG. 12), or clockwise as viewed from the top, the ratchet disc gear teeth 154*b* will push the pawl disc 151 to the left. The pawl disc 151 is engaged against the ramp disc 153 by the abutment of the teeth 154*a* against a point 180 of the teeth 160*b*. In an embodiment, the axial teeth 158*a* of the ratchet disc 152 engage the axial teeth 154*b* of the pawl disc 151 and transfer a load therebetween. The pawl disc 151 has multiple teeth 154*b* to engage the teeth 158*a* of the ratchet disc 152 to transfer of the torque-applying motion of the ratchet disc 152 to the ramp disc 153 and the drive body 170. The retaining ring or spring washer 181 applies a spring force to the pawl disc 151. Moving the ratchet disc 152 in the opposite direction, with the spring washer 181 holding the pawl disc 151 in place, will produce ratcheting or overrunning. The pawl disc 151 teeth climb each ramp of the ratchet disc 152 teeth to provide ratcheting. Therefore, clockwise rotation of the ratchet disc 152 will transfer torque, as the pawl disc 151 is in its locked position. Such a clockwise rotation will allow the square drive member 172 to apply torque to a fastener in a clockwise direction.

When the tool 100 is rotated counterclockwise, the ratchet disc 152 is rotated counterclockwise because the peripheral teeth 157 engage the geared inner wall portion 144 of the ratchet head 140 (unlike the first mechanism 131 which engages geared wall portion 146 of the tool body 110). When the pawl disc 151 is in the left position as shown in FIG. 12, a gap 191 is formed between the teeth of the pawl disc 151 and the ramp disc 153. Upon movement to the right by the ratchet disc 152, the pawl disc 151 is able to oscillate axially into the gap 191. The gap 191 allows for oscillation of the pawl disc 151 so that ratcheting may occur between the axial teeth 154*b* of the pawl disc 151 and the axial teeth 158*a* of the ratchet disc 152. The pawl disc 151 is maintained in this left position, abutting point 180 by the selector knob 120 holding the pawl disc 151 in this first engagement position.

In an embodiment, each ratchet disc 152 includes multiple teeth, axially arranged to form a "face gear," and each tooth has a ramped surface of approximately 30 to 45°. During ratcheting, the ratchet disc 152 attempts to rotate to the right. Because there is nothing to resist it; the ratchet disc 152 pushes each tooth 154*a* of the pawl disc 151 up the teeth 160*b* of the ramp disc 153, sliding along each tooth surface until a tooth crest is passed. Then a spring 200 pushes the pawl disc 151, providing overrun or ratcheting. So, the space 191 between the tooth of the pawl disc 151 and the next ramp of the tooth of the ramp disc 153 has to be at least one tooth space, to allow the oscillation—plus a little extra space. Thus, the ratcheting in a first direction is provided. The pawl disc 151 is biased with the spring 200, selectable by the actuator or selector knob 120. The spring 200 biases against the ramp of each tooth 160*b* of the ramp disc 153 so that the teeth 154*a* may ratchet against each ramp.

By turning the knob 120 to bias the pawl disc 151 to the right, the exact same action may be obtained in the other direction. Upon rotation of the selector knob 120 to the right, or counterclockwise, the knob 120 and shaft 205 rotate in order to lock the pawl disc 151 in position. The pawl disc 151 is moved to a second engagement position where the teeth 154*a* of the first pawl disc 151 will abut a second point 193 on the adjacent tooth so that torque may be applied when the ratchet disc 152 is rotated in a counterclockwise direction. Likewise in the second engagement position, ratcheting occurs in the clockwise direction. The spring 200 is provided in an aperture 201 formed in the pawl disc 151. The spring 200 is located across the diameter of the pawl disc 151 and allows for the pawl disc 151 to oscillate in an axial manner to allow for ratcheting.

Figure 12A:
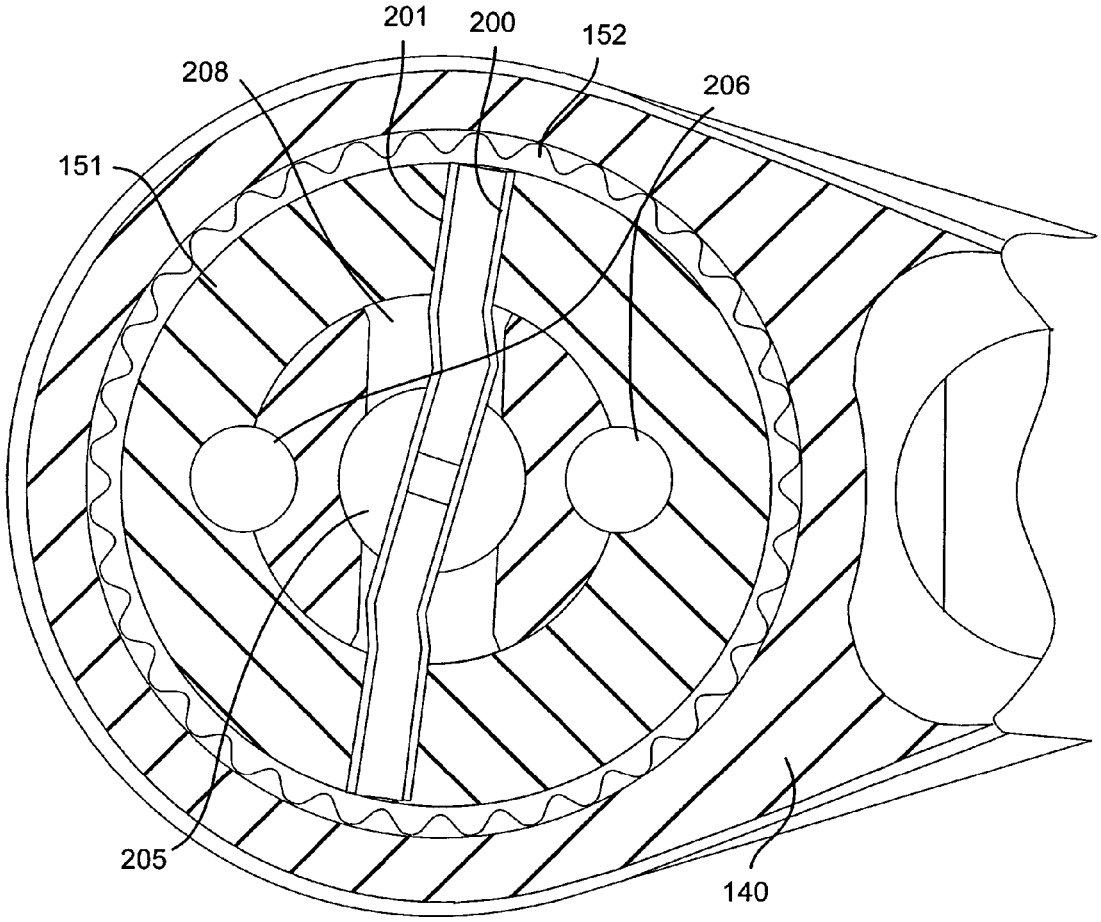
FIG. 12*a* is a sectional view of the axial pawl ratchet assembly of FIG. 12 taken at line 12*a*-12*a;*
Figure 13:
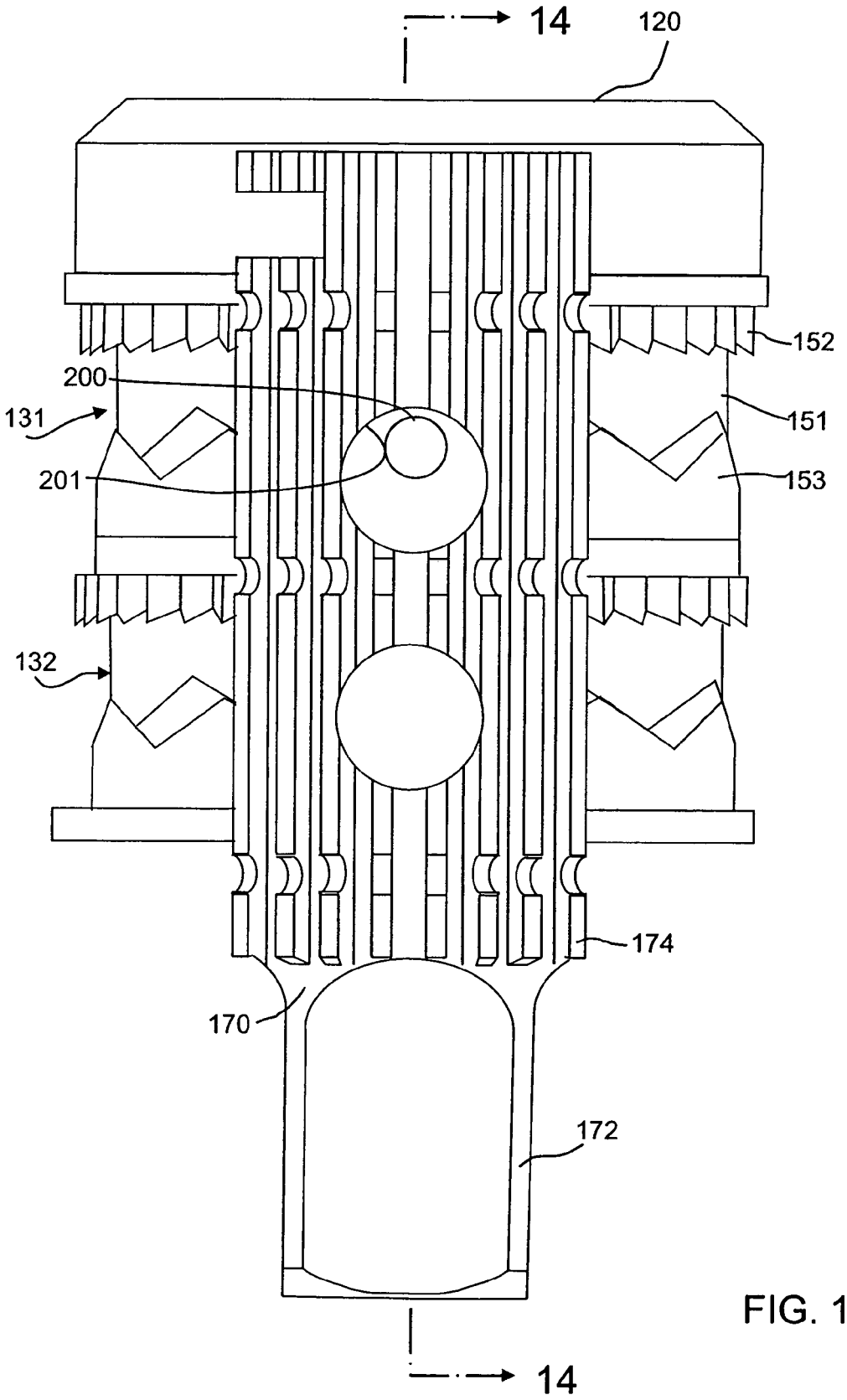
FIG. 13 is a reduced sectional view of the axial pawl ratchet assembly of FIG. 12 taken at line 13-13.

The selector knob 120 operates to preload the pawl disc 151 by rotating the selector knob 120 to its furthest clockwise or counter-clockwise position. In an embodiment, a shaft 205 is formed as one piece with the selector knob 120 (see FIG. 14). The shaft includes apertures 207, 208. The upper aperture 207 receives the upper spring 200 therein. In an embodiment the spring 200 is screwed into aperture 207 so that it is received all the way through the shaft 205 and engages a pair of apertures 201 in the pawl disc 151 located 180° apart. The spring 200 is interference fit in the selector knob 120 and it extends radially into holes in the pawl disc 151. The spring 200 does not put a side load on the pawl disc 151—in other words, there are balanced forces. In an embodiment, the spring 200 will apply a nicely balanced rotation to the pawl disc 151. The spring 200 is rigid enough so that upon rotation of the selector knob 120 the spring 200 will transfer the force of rotation to the pawl disc 151 so that it engages the teeth 160*b* of the ramp disc 153 adjacent its crests. However, in an embodiment, the spring 200 can deform longitudinally, for example, in a serpentine shape (see FIG. 12*a*), when the selector knob 120 is advanced to either the first or second engagement positions. A pair of keyways 206 are provided in the shaft 205 and pawl disc 151. Therefore, it may be understood that the spring 200 provides for a tangential preload force against the pawl disc 151 and also a helical force that allows for deflection of the pawl disc 151 to provide for ratcheting when the ratchet disc 152 is rotated in a non-torque applying direction, for example to the right in FIG. 12.

Figure 15:
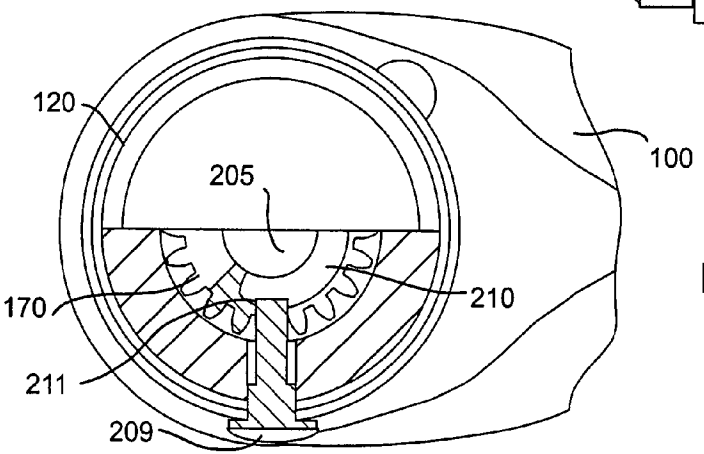
FIG. 15 is a top plan view in partial section taken at line 15-15 in FIG. 14.

In an alternate embodiment, some other resilient member may be used other than a spring 200. However, it is preferable for the resilient member to provide for omni-directional forces in order to allow for the pawl disc 151 to be moved in a preloaded torquing condition and also allow for a ratcheting deflection. In an embodiment, a fastener 209 (see FIGS. 14 and 15), for example a setscrew, is mounted in the head of the selector knob 120 in order to fasten the shaft 205 to the drive body 170. The drive body 170 includes a semicircular void 210, which receives a fastening head 211 of the fastener 209. As shown in FIG. 15, the selector knob 120 is rotated all the way clockwise to its engaged position and the fastening head 211 of the fastener 209 is abutting the end of the semicircular void 210. In order to lock the backstopping assembly 132 in this first engagement position, the fastener 209 may be tightened in order to clamp the fastener head 211 against the inner diameter wall of the semicircular void 210. This will lock the shaft 205 in its furthest clockwise position which simultaneously will lock the pawl disc 151 in its furthest clockwise position as shown in FIG. 12, via preloading by the spring 200.

In order to move the pawl disc 151 to the second engagement position, the fastener 209 may be loosened and the selector knob 120 may be rotated counter-clockwise so that the fastener head 211 moves in a counter-clockwise direction through the semicircular void 210 (see FIG. 15). Upon rotation of the selector knob 120 to the second engagement position, the fastener 209 may be tightened so that the fastener head 211 clamps the selector knob 120 end shaft 205 in the furthest counter-clockwise position. In an alternate embodiment, the set screw 209 may be replaced with other clamping means, such as a ball and detent assembly with a V-groove formed in the selector knob 120. Operation of the pawl disc 151 against the ratchet disc 152 gives the strength of many teeth in engagement and in a small package.

The first set of discs 131 operate as discussed above, however they provide an anti-chatter mechanism to counteract the oscillation of the ratchet head 140, so that every advance given by the oscillating mechanism 132 is taken and used. There is no slippage, and every advance does not have to fight friction.

Figure 23:
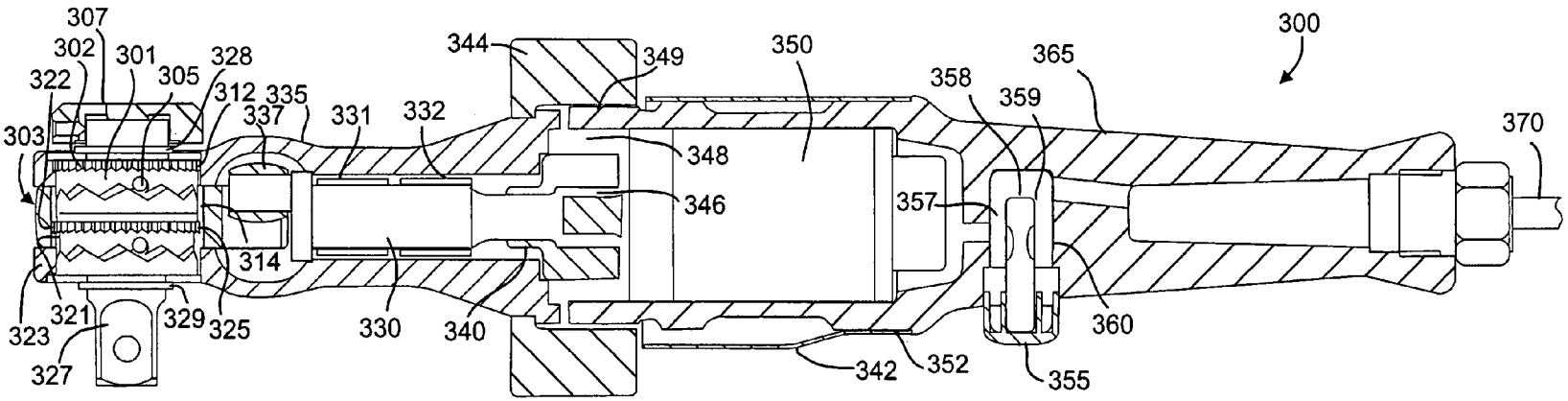
FIG. 23 is a longitudinal sectional view of an air wrench incorporating the ratchet mechanism of FIG. 12.

Turning to FIG. 23, an embodiment of the invention is shown with a high torque air ratchet tool 300. As discussed above, the tool 300 includes a pawl disc 301, a ratchet disc 302, and a ramp disc 303. A spring 305 is mounted within the pawl disc 301. The spring 305 acts in concert with selector knob 307 in order to adjust the assembly to a first or second engagement position. The discs 301, 302, 303 act between the outer diameter teeth 312 of the aperture 314 in order to provide a backstopping assembly. An additional assembly includes a pawl disc 321, ratchet disc 322 and ramp disc 323, which provide an anti-chatter force between the tool head 325 and the square drive 327. A retaining ring 328 helps to apply a force against the ratchet disc 302. Retaining ring 329 applies a force against the ramp disc 323.

The tool includes a drive shaft 330 surrounded by a pair of needle bearings 331, 332. The drive shaft 300 is surrounded by a ratchet housing 335 which also encloses a cylindrical bar element 337. The drive shaft 300 is attached via a gear carrier 340 to the muffler 342 at the clamp nut shim 344. Adjacent the gear pin 346 is a planetary gear 348 and internal gear 349. An air motor subassembly 350 is mounted within the muffler 342 and includes an O-ring 352 at the outer periphery of the muffler housing 342. A trigger button 355 is mounted to the housing and includes a trigger bushing 357, a trigger stem 358, an O-ring 359 and a retaining ring 360. The trigger button assembly 355 is mounted to the handle 365 and controls power from air inlet fitting 370. Therefore, it may be understood that the air ratchet tool 300 may provide for anti-chattering, ratcheting and torquing via each backstopping assembly including the pawl discs 301, 321; ratchet discs 302, 322; and ramp discs 303, 323.

While particular embodiments have been shown and described, it will be apparent to those skilled in the art that changes and modifications may be made without departing from the principles of the axial pawl ratchet mechanism in its broader aspects. The matters set forth in the foregoing description and accompanying drawings is offered by way of illustration only and not as a limitation.

What is claimed is:

1. An axial pawl ratchet mechanism comprising:

a ratchet assembly including:

a first disc including a first set of axial ratchet gear teeth on a first axial side thereof and a second set of axial ratchet gear teeth on a second axial side thereof, a second disc having axial ratchet gear teeth formed on a first axial side thereof engageable with the first disc first set of axial ratchet gear teeth, and having a set of radial gear teeth, a third disc having axial ratchet gear teeth formed on a first axial side thereof engageable with the first disc second set of axial ratchet gear teeth, and having a set of radial gear teeth, wherein the second and third disc form a drive subassembly, a bias assembly for biasing the axial ratchet gear teeth of the second and third discs into engagement with the axial ratchet gear teeth of the first disc;

a ratchet body through which torque can be applied, the ratchet body including first and second sets of radial gear teeth;

a manually actuable actuator coupled to the drive subassembly and rotatable, without translation relative to the ratchet body, to shift the first disc relative to the drive subassembly to and between a first engagement position having the radial teeth of the second disc engaged with the ratchet body first set of radial gear teeth for providing torque in a first drive direction, the axial teeth of the second disc engaged with the first set of axial teeth of the first disc, and the third disc axial teeth being disengaged from the second set of axial teeth of the first disc, and a second engagement position having the radial teeth of the third disc engaged with the ratchet body second set of radial gear teeth for providing torque in a second drive direction, the axial teeth of the third disc engaged with the second set of axial teeth of the first disc, the second disc axial teeth being disengaged from the first set of axial teeth of the first disc; and a shaft having a track formed therein, the track being engageable with the actuator, wherein movement of the actuator directs the track in an axial direction to shift the first disc to and between the first and second engagement positions, the track is a spiral groove cut into the shaft, and the actuator includes a detent in engagement with the track such that rotation of the actuator and detent shifts the first disc axially.

2. The axial pawl ratchet mechanism of claim 1 further including a drive body having a drive end and an adjustment end.

3. The axial pawl ratchet mechanism of claim 2 wherein the actuator is attached to the adjustment end of the drive body and the actuator may provide for adjusting of the axial position of the drive body between the first engagement position and the second engagement position.

4. The axial pawl ratchet mechanism of claim 2 wherein the drive body includes an outer diameter engagement portion for engaging inner diameter teeth of the ratchet assembly.

5. The axial pawl ratchet mechanism of claim 2 wherein at least a portion of the ratchet assembly is locked to the drive body and the drive body may rotate within the ratchet body.

6. The axial pawl ratchet mechanism of claim 5 wherein the first disc is rotationally fixed within the ratchet body.

7. The axial pawl ratchet mechanism of claim 1 wherein the actuator includes a drive body having a pawl carrier to which the ratchet assembly is maintained in order to actuate between first and second engagement positions.

8. The axial pawl ratchet mechanism of claim 1 wherein the axial gear teeth of the discs pass over one another to provide overrunning or ratcheting.

9. The axial pawl ratchet mechanism of claim 1 wherein a second mechanism provides a backstop to the ratchet body to provide anti-chatter friction so that every advance given by oscillating the second mechanism is used and prevents slippage.

10. The axial ratchet pawl mechanism of claim 1 wherein the first disc is a bidirectional disc.

11. The axial pawl ratchet mechanism of claim 1 wherein the detent is a ball biased into engagement with the track.

12. The axial pawl ratchet mechanism of claim 1 wherein the ratchet body includes an opening for receiving the ratchet assembly therein.

13. The axial pawl ratchet mechanism of claim 12 wherein the ratchet body is oscillated and rotates the second disc in the first engagement position and rotates the third disc in the second engagement position via the radial gear teeth interconnected with the radial teeth of the ratchet body.

14. The axial pawl ratchet mechanism of claim 12 wherein the ratchet body radial gear teeth extend radially inwardly into the opening.

15. The axial pawl ratchet mechanism of claim 1 wherein the actuator comprises a selector knob.

* * * * *